US008733925B2

(12) United States Patent
Izawa et al.

(10) Patent No.: US 8,733,925 B2
(45) Date of Patent: May 27, 2014

(54) INKJET RECORDING APPARATUS

(75) Inventors: Hideo Izawa, Chiba (JP); Kouichi Ooyama, Akita (JP); Masahito Sato, Akita (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 30 days.

(21) Appl. No.: 13/540,767

(22) Filed: Jul. 3, 2012

(65) Prior Publication Data

US 2013/0016165 A1 Jan. 17, 2013

(30) Foreign Application Priority Data

Jul. 13, 2011 (JP) ..... 2011-155272

(51) Int. Cl.
*B41J 2/01* (2006.01)

(52) U.S. Cl.
USPC ..... 347/104; 347/101; 347/105; 347/16

(58) Field of Classification Search
USPC ..... 347/104, 101, 105, 16
See application file for complete search history.

(56) References Cited

U.S. PATENT DOCUMENTS

| | | | | |
|---|---|---|---|---|
| 6,168,269 | B1 * | 1/2001 | Rasmussen et al. | 347/102 |
| 7,819,519 | B2 * | 10/2010 | Eve | 347/104 |
| 2006/0066710 | A1 * | 3/2006 | Fukui | 347/139 |
| 2006/0232624 | A1 | 10/2006 | Inoue | |
| 2007/0296791 | A1 | 12/2007 | Eve | |
| 2010/0171782 | A1 * | 7/2010 | Kado et al. | 347/16 |

OTHER PUBLICATIONS

European Patent Office Search Report issued in European Application No. 12 174 899.0 dated Nov. 16, 2012 (5 pages).

* cited by examiner

*Primary Examiner* — Henok Legesse
(74) *Attorney, Agent, or Firm* — Flynn, Thiel, Boutell & Tanis, P.C.

(57) ABSTRACT

An inkjet recording apparatus 100 makes a record on a web 1, including a line head 10 disposed on the side of a recording surface 1*a* of the web 1, guiding rollers 2 that guide the web 1, and a suction mechanism 20 disposed on the side of a non-recording surface 1*b* of the web 1, wherein, during travelling of the web 1, the line head 10 makes a record on the recording surface 1*a* of the web 1, and the suction mechanism 20 secures the non-recording surface 1*b* of the web 1.

5 Claims, 6 Drawing Sheets

INKJET RECORDING APPARATUS

TECHNICAL FIELD

The present invention relates to an inkjet recording apparatus and, in particular to an inkjet recording apparatus in which web travelling stability is improved by inhibiting a travelling web from vibrating so that a recorded object with a high quality is obtained.

BACKGROUND ART

An inkjet recording apparatus is used in various fields since it can record desired patterns such as designs or letters, easily and precisely.

In recent years, along with a refinement of patterns or improvement of expressiveness, it has also been required to further improve the quality of a recorded object obtained by the inkjet recording apparatus.

By the way, in the inkjet recording apparatus, it is desired in view of production efficiency that a web travels at as high a speed as possible, but high-speed travelling of the web inevitably causes the web to flap. In addition, there is the disadvantage that the degree of flapping increases with a longer distance between guide rollers that guide the web, and the quality of the recorded object decreases accordingly. Therefore, methods for inhibiting flapping of the web have been considered.

For example, an inkjet recording apparatus is known in which a sheet path opposite a nozzle face of each inkjet head is formed by two guide rollers located upstream and downstream of a travelling direction of a sheet and respective upstream and downstream ends of a nozzle width region of each inkjet head in the travelling direction of the sheet are positioned within between the upstream and downstream guide rollers beyond contact points at which the sheet comes into rolling contact with the upstream and downstream guide rollers (for example, see a patent document 1). In such an inkjet recording apparatus, the ends are positioned illimitably close to the contact points, by which flapping of the sheet is prevented.

PRIOR ART

Patent Document

Patent Document 1 Japanese Patent Application Laid-Open No. 2010-99955

SUMMARY OF THE INVENTION

Problem to be Solved by the Invention

In the inkjet recording apparatus described in the patent document 1, however, flapping of the sheet is certainly inhibited, but it cannot necessarily be said to be sufficient.

Particularly in a configuration where four or more inkjet heads are arranged, it is difficult to keep the web travelling stable.

The present invention has been made in view of these circumstances, and an object of the present invention is to provide an inkjet recording apparatus that can provide a recorded object with a high quality by reliably inhibiting the flapping of a travelling web to improve the travelling stability.

The present inventors have made intensive researches in order to solve the above problem, have found that the above problem can be solved by disposing a suction mechanism on the side of a non-recording surface of a web, and sucking the non-recording surface of the web during travelling of the web so as to create a negative pressure, and have completed the present invention.

That is, the present invention lies in (1) an inkjet recording apparatus that makes a record on a web, including: a line head disposed on the side of a recording surface of the web; guide rollers that guide the web; and a suction mechanism disposed on the side of a non-recording surface of the web, wherein, during travelling of the web, the line head makes a record on the recording surface of the web, and the suction mechanism sucks the non-recording surface of the web.

The present invention lies in (2) the inkjet recording apparatus described in the above (1), wherein the suction mechanism has thin guide rollers that come in contact with the web, and a suction hole provided between the thin guide rollers adjacent to each other, and the non-recording surface of the web is sucked through the suction hole.

The present invention lies in (3) the inkjet recording apparatus described in the above (2), wherein the suction mechanism is further provided with an adjustment mechanism that adjusts the degree of suction.

The present invention lies in (4) the inkjet recording apparatus described in the above (2) or (3), further including a main body frame that contains the line head, the guide rollers, and the suction mechanism, wherein the thin guide rollers are rotatably attached to support members provided in the main body frame via bearings.

The present invention lies in (5) the inkjet recording apparatus described in any one of the above (1) to (4), wherein a plurality of the line heads is provided side by side, and a plurality of the suction mechanisms is disposed so as to correspond to the respective line heads.

The present invention lies in (6) the inkjet recording apparatus described in any one of the above (1) to (5), wherein a plurality of the line heads is provided side by side, and lower faces of the plural line heads are disposed in an arch shape.

The present invention lies in (7) the inkjet recording apparatus described in any one of the above (1) to (6), further including a dryer for drying the web after the line head has made a record on the web.

Advantageous Effects of the Present Invention

In the inkjet recording apparatus of the present invention, the suction mechanism sucks the non-recording surface of the web, thereby creating a negative pressure so that the web is attracted to the guide rollers. This reliably inhibits flapping of the web even while the web is travelling, and therefore travelling stability can be maintained.

As a result, flapping of the web is inhibited when a jet of ink from the line head comes to attach to the web, and therefore a recorded object with a high quality can be obtained.

In addition, contact between the web and the line head can be prevented, and therefore the nozzle of the line head can be prevented from being damaged.

Furthermore, the frequency of occurrence of recording troubles due to generation of paper dust can be reduced at the same time.

In the inkjet recording apparatus of the present invention, when the suction mechanism is provided with thin guide rollers, the web becomes able to travel along the thin guide rollers since the web is sucked through the suction hole. For example, by disposing the thin guide rollers linearly, the travelling path of the web can be made linear accordingly.

In addition, when the thin guide rollers are attached to support members provided in the main body frame via bearings so as to be freely rotatable, the web can be made to travel further smoothly.

In the inkjet recording apparatus of the present invention, when the suction mechanism is provided with an adjustment mechanism, the degree of suction can be optimally adjusted according to the degree of flapping based on the travelling speed of the web.

In the inkjet recording apparatus of the present invention, when a plurality of the line heads are provided side by side and a plurality of the suction mechanisms are disposed so as to correspond to the respective line heads, flapping of the web can be more reliably inhibited through all the line heads.

In the inkjet recording apparatus of the present invention, when a plurality of the line head are provided side by side, and lower faces of the plurality of the line heads are disposed in an arch shape, the web can be tensed in the opposite direction of the line heads and flapping of the web can be more reliably inhibited.

In the inkjet recording apparatus of the present invention, when a dryer is provided, the web can be dried continuously after a record is made on the web. Therefore, a recorded object can be efficiently obtained from the inkjet recording apparatus.

EMBODIMENTS FOR CARRYING OUT THE INVENTION

Figure 1:
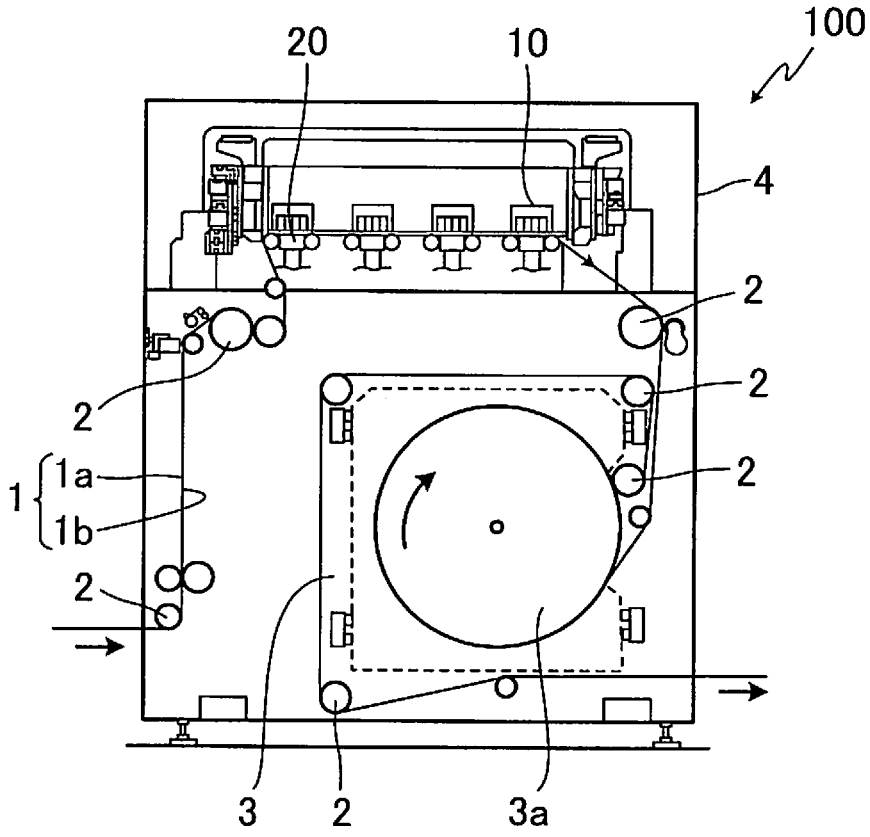
FIG. 1 is a schematic view showing an embodiment of an inkjet recording apparatus according to the present invention.

Hereinafter, with reference to the drawings, if necessary, preferred embodiments of the present invention will be described in detail. It should be noted that throughout the drawings identical elements are denoted by identical reference numerals in order to omit overlapping descriptions. In addition, positional relations, such as top and bottom or right and left, are based on positional relations as shown by the drawings, unless otherwise noted. Furthermore, dimensional ratios of the drawings are not limited to dimensional ratios as shown by the drawings.

FIG. 1 is a schematic view showing an embodiment of an inkjet recording apparatus according to the present invention.

As shown in FIG. 1, an inkjet recording apparatus 100 according to the present embodiment is provided with a plurality of line heads 10 disposed on the side of a recording surface 1*a* of a web 1, a plurality of guide rollers 2 guiding the web 1, suction mechanisms 20 disposed on the side of a non-recording surface 1*b* of the web 1, and a dryer 3 for drying the web 1 on which a record has been made by the line heads 10.

In addition, the line heads 10, the guide rollers 2, the suction mechanisms 20, and the dryer 3 are housed in a main body frame 4. Thus, the inkjet recording apparatus 100 is designed to minimize the leakage of floating ink or noise from the main body frame 4.

In the inkjet recording apparatus 100 according to the present embodiment, the material of the web 1 includes, but is not particularly limited to, paper, fabric, film, metal foil, or the like. Furthermore, the web 1 is capable of travelling continuously.

In the inkjet recording apparatus 100 according to the present embodiment, four line heads 10 are disposed side by side. Such four line heads 10 are capable of making a continuous record on the web 1.

Figure 2:
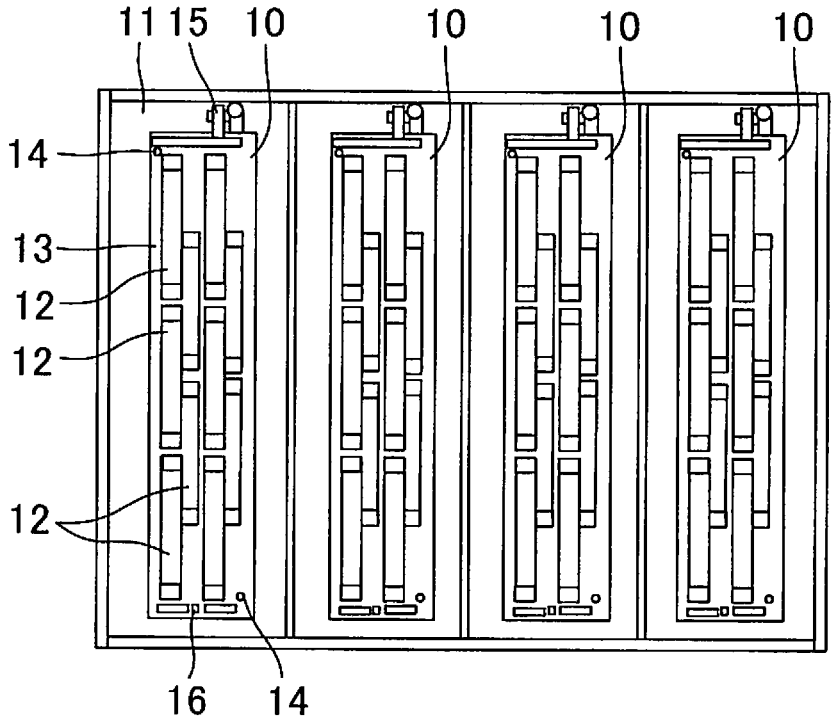
FIG. 2 is a top view showing a plurality of line heads in the inkjet recording apparatus according to the present embodiment.

FIG. 2 is a top view showing the plurality of line heads in the inkjet recording apparatus according to the present embodiment.

As shown in FIG. 2, all four line heads 10 are positionally fixed to a base plate 11 provided in the main body frame 4. It should be noted that the respective line heads 10 are independently detachable from the base plate 11 and, if necessary, can be replaced accordingly.

Each line head 10 is configured to have a plurality of short heads arranged in a zigzag pattern on a base plate for a head 13.

The base plate for a head 13 has a positioning pin 16 on one end thereof so that the base plate for a head 13 is positioned to the main body frame 4. The base plate for a head 13 is fixed to the base plate 11 on both ends thereof by fixation screws 14. It should be noted that the base plate for a head 13 is in contact with a swing device 15 provided in the base plate 11 at the other end thereof, and such a swing device 15 makes it possible to perform a fine adjustment of the position of the base plate for a head 13 using the position of the positioning pin 16 as a pivot.

The four line heads 10 each contain ink. It should be noted that these inks may be the same color or different colors. It should also be noted that the ink may be a dye or pigment, and that the ink may be water-based or oil-based.

For example, in a case where a record is made by using the four line heads 10 containing yellow, magenta, cyan, and black, full color can be expressed. Or, in a case where line heads 10 containing inks which are of the same colors but different in concentration are further provided, and a record is made by all these line heads 10, the range of expressible colors is expanded. It should be noted that it is also possible to use as an ink a solution in which an ultraviolet-curable agent, a glazing agent, a flame retardant, a foundation agent, or the like is dissolved.

A plurality of suction mechanisms 20 are provided so as to correspond to the respective line heads 10 arranged side by side. This makes it possible to more reliably inhibit flapping of the web 1.

Figure 3:
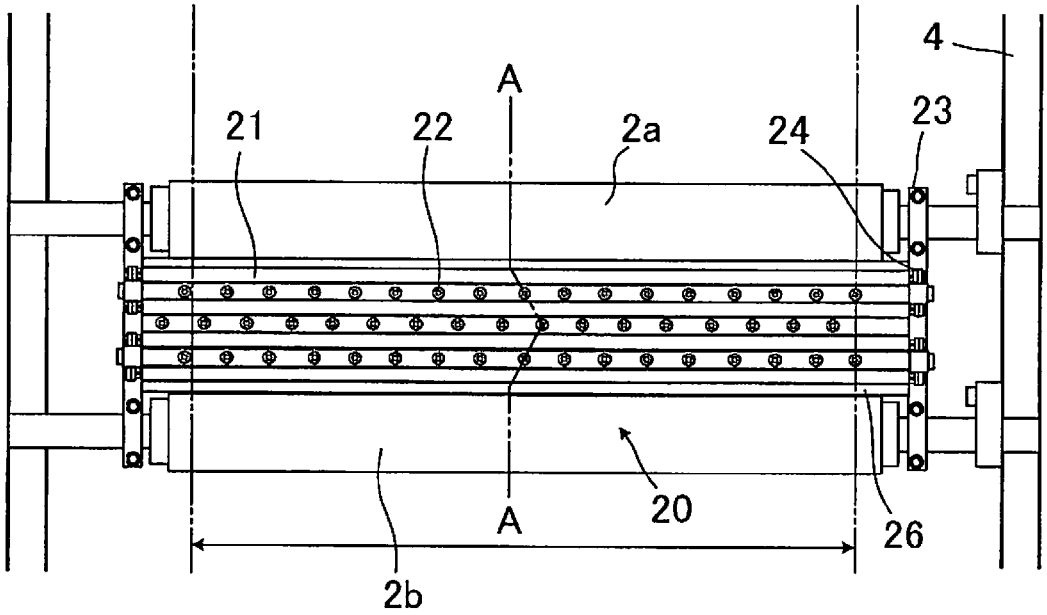
FIG. 3(*a*) is a top view showing a suction mechanism in the inkjet recording apparatus according to the present embodiment, and FIG. 3(*b*) is a sectional view taken along line A-A in FIG. 3(*a*).
Figure 3:
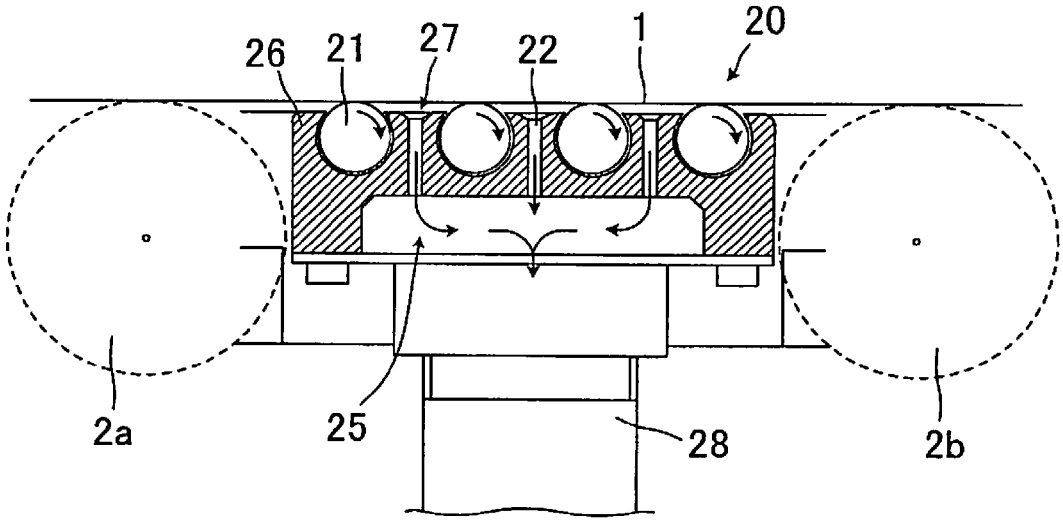

FIG. 3(*a*) is a top view showing the suction mechanism in the inkjet recording apparatus according to the present embodiment, and FIG. 3(*b*) is a sectional view taken along line A-A in FIG. 3(*a*).

As shown in FIG. 3(*a*) and FIG. 3(*b*), the suction mechanism 20 is fixed between a guide roller (hereinafter referred to as "left guide roller" for convenience) 2*a* on the left of (i.e., upstream of) the suction mechanism 20 and a guide roller (hereinafter referred to as "right guide roller" for convenience) 2*b* on the right of (i.e., downstream of) the suction mechanism 20. It should be noted that both the left guide roller 2*a* and the right guide roller 2*b* are attached to support members 23 provided in the main body frame 4.

Here, in the inkjet recording apparatus 100, since the suction mechanism 20 is fixed to the left guide roller 2*a* and the right guide roller 2*b*, the suction mechanism 20, the left guide roller 2*a*, and the right guide roller 2*b* can be unified. This simplifies components, and provides a precision improvement effect since each positional relation is fixed.

The suction mechanism 20 has a vacuum main body 26, four thin guide rollers 21 disposed in an upper face of the vacuum main body 26, a plurality of suction holes 22 which are arranged in a row between adjacent thin guide rollers 21 in the vacuum main body 26 and which are opened downward so as to communicate with the vacuum main body 26, a negative pressure chamber 25 provided within the vacuum main body 26, and a suction blower (not shown) which creates a negative pressure in the negative pressure chamber.

The respective thin guide rollers 21 are supported between the support members 23 provided in the main body frame 4 and attached via bearings 24 so as to be freely rotatable independently.

In addition, since the thin guide rollers 21 are disposed in contact with the web 1, they rotate according to travelling of the web.

Here, the suction mechanism 20 is provided with three rows of suction holes 22, each row being composed of a plurality of suction holes 22 arranged at equal intervals.

In addition, as shown in FIG. 3(*a*), the suction holes 22 are arranged in a zigzag pattern to each other in the vacuum main body 26.

Figure 4:
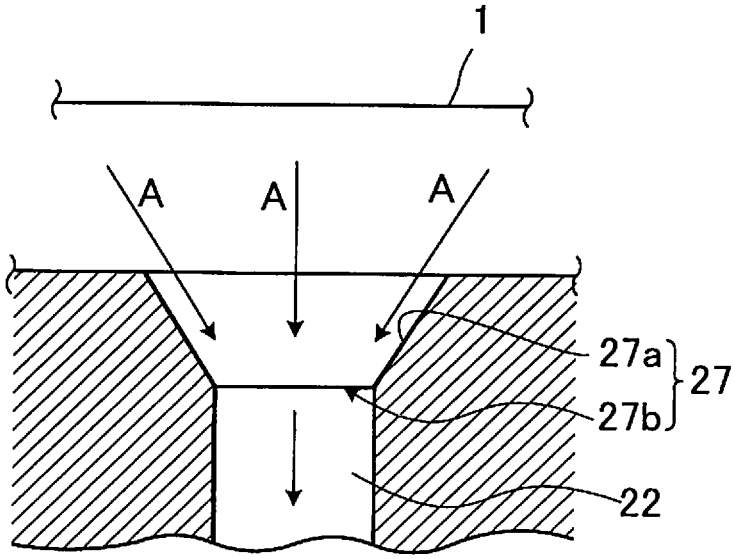
FIG. 4 is an enlarged sectional view describing a suction hole in the inkjet recording apparatus according to the present embodiment.

FIG. 4 is an enlarged sectional view describing an entrance of the suction hole in the inkjet recording apparatus according to the present embodiment.

As shown in FIG. 4, an entrance 27 of the suction hole is composed of a tapered side portion 27*a* and a bottom portion 27*b* enclosed by the side portion 27*a*. The suction hole 22 is bored at the bottom portion 27*b*.

Since the side portion 27*a* of the entrance 27 of the suction hole is tapered, suction can be extensively performed not only from above the suction hole 22 but also from around the suction hole 22 in the directions of arrows A. This makes it possible to suck the web 1 not partially but relatively extensively.

Referring back to FIG. 3(*a*) and FIG. 3(*b*), all of the suction holes 22 communicate with the negative pressure chamber 25, and the negative pressure chamber 25 is connected via a hose 28 to a suction blower which is a suction source (not shown).

By performing suction by means of the suction blower, negative pressure is created in the negative pressure chamber 25 via the hose 28 and, simultaneously, the air on the side of the non-recording surface 1*b* of the web 1 is sucked through the suction holes 22.

Figure 5:
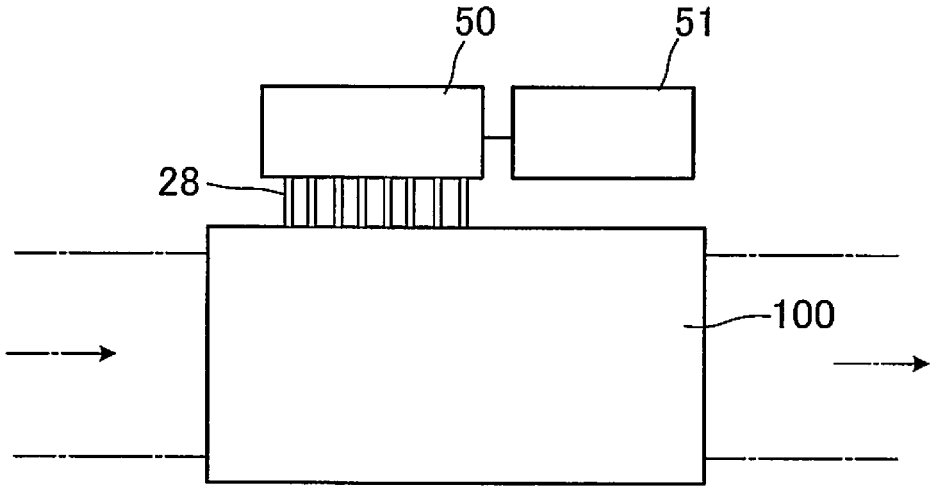
FIG. 5 is a schematic plan view showing the inkjet recording apparatus according to the present embodiment.

FIG. 5 is a schematic plan view showing the inkjet recording apparatus according to the present embodiment.

As shown in FIG. 5, the suction mechanism 20 is further provided with a suction blower 50 that creates a negative pressure in the negative pressure chamber 25, and an adjustment mechanism 51 that adjusts the degree of suction of the suction blower 50. It should be noted that, in the inkjet recording apparatus 100 according to the present embodiment, the adjustment mechanism 51 is composed of a controller that controls the rate of rotation of the suction blower 50.

Since the suction mechanism 20 is provided with the adjustment mechanism 51, the degree of suction can be properly adjusted according to the degree of flapping based upon the travelling speed of the web 1.

Referring back to FIG. 1, the dryer 3 is disposed below the line heads 10. This can make an installation space for the inkjet recording apparatus 100 compact.

The dryer 3 is provided with a heater inside and the heat of the heater heats the surface of the drum 3*a*. In addition, the dryer 3 is provided with a blow nozzle (not shown) and this blow nozzle is configured to blow hot air to the surface of the drum 3*a*. That is, in the dryer 3, the web wound on the surface of the drum 3*a* is dried by these two drying functions.

In the inkjet recording apparatus 100 according to the present embodiment, since the dryer 3 is thus provided, after a record has been made on the web 1, the web 1 can be directly dried as it is. This makes it possible to obtain a recorded object efficiently.

In the inkjet recording apparatus 100 according to the present embodiment, the web 1 carried in is guided by the guide rollers 2 to below the line heads 10.

Then, a record is made on the recording surface 1*a* of the web 1 by the plurality of line heads 10 disposed on the side of the recording surface 1*a* of the web 1. At this time, the non-recording surface 1*b* of the web 1 is sucked through the suction holes 22 of the suction mechanism 20. This creates a negative pressure on the side of the non-recording surface 1*b* of the web 1, so that the web 1 is attracted to the side of the guide rollers 2 and the thin guide rollers 21 to travel stably along the guide rollers 2 and the thin guide rollers 21 without flapping. It should be noted that, as described above, the thin guide rollers 21 are freely rotatable, so that the web 1 can be caused to travel smoothly.

Then, the web 1 on which a record has been made is guided to the dryer 3 disposed below, and wound substantially around the circumference of the drum 3*a*, and dried from the side of the non-recording surface 1*b* of the web 1. It should be noted that when the web 1 is wound around the drum 3*a*, the non-recording surface 1*b* of the web 1 comes in contact with the drum 3*a*. This also inhibits contamination of the drum 3*a*. This leads to an efficient drying of the web 1 and also inhibits the contamination of the drum 3*a*. A recorded object is thus obtained and carried out from the inkjet recording apparatus 100.

It should be noted that, in the inkjet recording apparatus 100, carrying-in methods for the web 1 includes, for example, a method of carrying the web 1 wound around a take-up roller in the inkjet recording apparatus 100. Also, methods of carrying out a recorded object include, for example, a method of winding a recorded object by a take-up roller, thereby carrying out the recorded object.

In the inkjet recording apparatus 100 according to the present invention, even when the web 1 is travelling, flapping of the web 1 is reliably inhibited and, therefore, travelling stability can be improved.

As a result, the web 1 is always in a stable state during recording, that is, when a jet of ink from the line head 10 becomes attached to the web 1 and, therefore, a recorded object with higher quality can be obtained.

In addition, since the web and the line head can be prevented from coming into contact with each other, a nozzle of the line head can be prevented from being broken.

Furthermore, the frequency of occurrence of recording troubles due to the generation of paper dust can be reduced.

Hereinabove, the embodiment of the present invention has been described, but the present invention is not limited to such an embodiment.

For example, in the inkjet recording apparatus 100 according to the above embodiment, the lower faces of the line heads 10 are linearly arranged but a plurality of lower faces of the line heads may be arranged in an arch shape.

Figure 6:
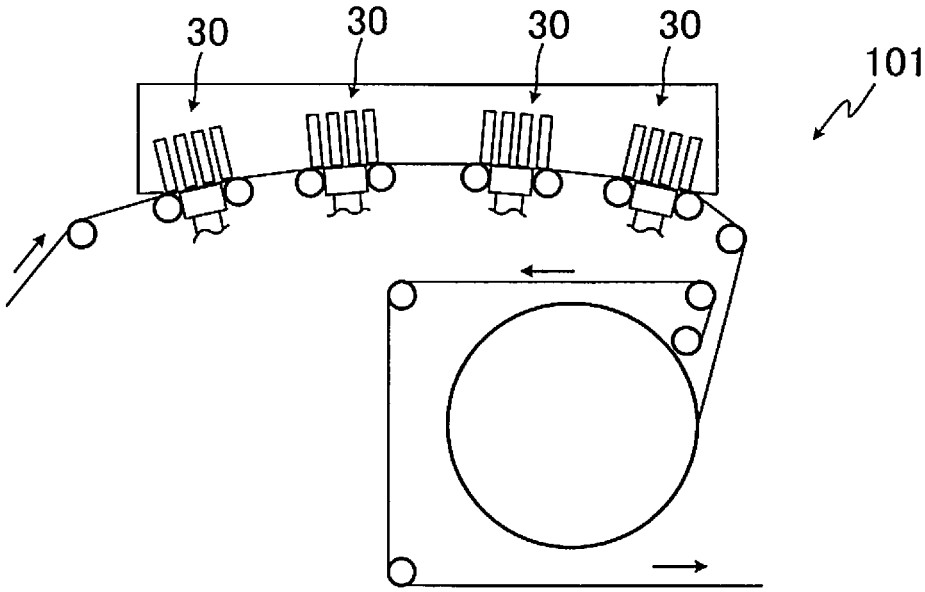
FIG. 6 is a schematic view showing an inkjet recording apparatus according to another embodiment.

FIG. 6 is a schematic view showing an inkjet recording apparatus according to another embodiment.

As shown in FIG. 6, in an inkjet recording apparatus 101 according to another embodiment, a plurality of the lower faces of the line heads 30 are arranged in an arch shape. This can tense the web 1 in the opposite direction of the line heads 30 and, therefore, flapping of the web 1 can be further inhibited.

In the inkjet recording apparatus 100 according to the present embodiment, four line heads are arranged side by side, but one to three line heads can be adopted, or five or more line heads can also be adopted. It should be noted that it is preferred that the suction mechanism 20 in this case is provided so as to correspond to the number of line heads.

In the inkjet recording apparatus 100 according to the present invention, the suction mechanism 20 is provided with four thin guide rollers 21 and three rows of suction holes 22, each row being composed of a plurality of suction holes 22 arranged at equal intervals, but the number of thin guide rollers and the number of rows of suction holes 22, each row being composed of a plurality of suction holes 22 arranged at equal intervals, are not particularly limited. Also, the suction holes 22 are arranged in a zigzag pattern to each other in the vacuum main body 26, but this is not a limitation and, for example, the suction holes 22 may be arranged in a grid pattern.

In the inkjet recording apparatus 100 according to the present invention, the suction blower 50 and the adjustment mechanism 51 are disposed outside the main body frame 4 but the suction blower and the adjustment mechanism may be disposed within the main body frame 4. In this case, there is a space-saving advantage.

In the inkjet recording apparatus 100 according to the present invention, a drum-type dryer is used as the dryer but, in a case where an ultraviolet curable agent is contained in the ink, the dryer may be an UV dryer. In this case, sufficient drying can be provided by simple equipment, and therefore there is a space-saving advantage.

In the inkjet recording apparatus 100 according to the present invention, a record is made on the recording surface 1*a* of the web 1, but it is also possible to make a record on the non-recording surface 1*b* after making a record on the recording surface 1*a* of the web 1.

That is, in a case where a record is made on the non-recording surface 1*b* of the web 1, the recording surface 1*a* and the non-recording surface 1*b* are switched during travelling. This makes it possible to make a record on both the surfaces of the web 1.

INDUSTRIAL APPLICABILITY

An inkjet recording apparatus of the present invention is applicable as an apparatus that employs an inkjet recording system to make a record on a web. According to such an inkjet recording apparatus, a recorded object with a high quality can be obtained.

DESCRIPTION OF REFERENCE NUMERALS

1 . . . Web
1*a* . . . Recording surface
1*b* . . . Non-recording surface
2 . . . Guide roller
2*a* . . . Left guide roller (guide roller)
2*b* . . . Right guide roller (guide roller)
3 . . . Dryer
3*a* . . . Drum
4 . . . Main body frame
10, 30 . . . Line head
11 . . . Base plate
12 . . . Short head
13 . . . Base plate for a head
14 . . . Fixation screw
15 . . . Swing device
16 . . . Positioning pin
20 . . . Suction mechanism
21 . . . Thin guide roller
22 . . . Suction hole
23 . . . Support member
24 . . . Bearing
25 . . . Negative pressure chamber
26 . . . Vacuum main body
27 . . . Entrance of a suction hole
27*a* . . . Side portion
27*b* . . . Bottom portion
28 . . . Hose
50 . . . Suction blower
51 . . . Adjustment mechanism
100, 101 . . . Inkjet recording apparatus

The invention claimed is:

1. An inkjet recording apparatus for making a recording on a web, comprising:

a plurality of line heads provided in a side-by-side relationship on a recording surface side of the web;

guide rollers for guiding the web;

a suction mechanism disposed on a non-recording surface side of the web for exerting a suction force on the web, wherein the plurality of line heads have lower faces provided in an arc shape, the suction mechanism has thin guide rollers that come into contact with the web and a suction hole provided between adjacent thin guide rollers, a side portion of an entrance of the suction hole is tapered and during travelling of the web, the line heads make a recording on the recording surface of the web and the suction mechanism exerts a suction force on the non-recording surface side of the web through the suction hole.

2. The inkjet recording apparatus according to claim 1, wherein the suction mechanism is further provided with an adjustment mechanism that adjusts the degree of suction.

3. The inkjet recording apparatus according to claim 1, further comprising a main body frame that contains the line head, the guide rollers, and the suction mechanism, wherein the thin guide rollers are rotatably attached to support members provided in the main body frame via bearings.

4. The inkjet recording apparatus according to claim 1, wherein a plurality of the suction mechanisms are disposed so as to correspond to respective line heads.

5. The inkjet recording apparatus according to claim 1, further comprising a dryer for drying the web after the line heads have made a recording on the web.

* * * * *